US006797332B2

(12) United States Patent
Strangman et al.

(10) Patent No.: US 6,797,332 B2
(45) Date of Patent: Sep. 28, 2004

(54) METHOD FOR FORMING A CARBON DEPOSIT INHIBITING THERMAL BARRIER COATING FOR COMBUSTORS

(75) Inventors: Thomas E. Strangman, Prescott, AZ (US); Dave Narasimhan, Flemington, NJ (US); Jeffrey P. Armstrong, Tempe, AZ (US); Keith R. Karasek, Elk Grove Village, IL (US)

(73) Assignee: Honeywell International, Inc., Morristown, NJ (US)

( * ) Notice: Subject to any disclaimer, the term of this patent is extended or adjusted under 35 U.S.C. 154(b) by 0 days.

(21) Appl. No.: 10/659,086

(22) Filed: Sep. 9, 2003

(65) Prior Publication Data

US 2004/0047998 A1 Mar. 11, 2004

Related U.S. Application Data

(62) Division of application No. 09/932,246, filed on Aug. 16, 2001, now Pat. No. 6,656,600.

(51) Int. Cl.[7] ..... C23C 4/10

(52) U.S. Cl. ..... 427/454; 427/585; 427/596; 427/248.1; 427/419.3; 427/435

(58) Field of Search ..... 427/454, 585, 427/596, 248.1, 435, 419.3

(56) References Cited

U.S. PATENT DOCUMENTS

| | | | | | |
|---|---|---|---|---|---|
| 4,055,705 | A | | 10/1977 | Stecura et al. | |
| 4,248,940 | A | | 2/1981 | Goward et al. | |
| 4,861,618 | A | | 8/1989 | Vine et al. | |
| 5,073,433 | A | | 12/1991 | Taylor | |
| 5,338,577 | A | * | 8/1994 | Burdette, II | 427/453 |
| 5,350,599 | A | * | 9/1994 | Rigney et al. | 427/255.7 |
| 5,514,482 | A | | 5/1996 | Strangman | |
| 5,683,825 | A | * | 11/1997 | Bruce et al. | 428/698 |
| 5,914,189 | A | * | 6/1999 | Hasz et al. | 428/335 |
| 6,258,467 | B1 | * | 7/2001 | Subramanian | 428/633 |

* cited by examiner

*Primary Examiner*—Katherine A. Bareford
(74) *Attorney, Agent, or Firm*—Robert Desmond, Esq.

(57) ABSTRACT

A method for forming a carbon deposit inhibiting thermal barrier coating for an internal element or component of a gas turbine engine. Such coating includes a layer of thermal barrier material coated onto the surface of an engine component that will be exposed to the flow of burning engine gases. Such coating further includes a layer of carbon deposit inhibiting material coated on top of the layer of thermal barrier material.

25 Claims, 1 Drawing Sheet

METHOD FOR FORMING A CARBON DEPOSIT INHIBITING THERMAL BARRIER COATING FOR COMBUSTORS

CROSS REFERENCE TO RELATED APPLICATION

This is a divisional application of U.S. application Ser. No. 9/932,246, filed Aug. 16, 2001, now U.S. Pat. No. 6,656,600.

BACKGROUND OF THE INVENTION

This invention relates to thermal barrier coatings for protecting internal components in a gas turbine engine from oxidation and corrosion during engine operation.

When a stream of incompletely burned atomized fuel droplets reaches the wall of the combustor in a gas turbine engine, a localized reducing atmosphere is created. This enables carbon deposits to form on the combustor wall. This condition usually occurs after the spray pattern of one or more fuel nozzles deteriorates, producing larger liquid fuel droplets. If the carbon deposits can bond to the combustor wall, large carbon nodules (several cubic centimeters in volume) can build up. Such localized reducing conditions can also cause carbon to form from fuel droplets prior to their collision with the wall. These small carbon particles can then bond upon impact with the wall, leading to carbon build-up. Periodic breaking off of pieces of these carbon deposits results in significant erosion damage to turbine airfoils, particularly to the first stage turbine blades, which impact with the carbon particles at speeds up to 2000 feet per second. Impact with turbine blades typically pulverizes the carbon nodules into much finer particles. Trailing edges of high-pressure turbine vanes and coatings on turbine shrouds are also damaged by grit blasting by high speed debris from pulverized carbon nodules.

Carbon bonding to the combustor wall is facilitated when the localized gaseous environment produced by the stream of impinging fuel droplets reduces carbide forming surface oxides. For example, for an uncoated superalloy combustor wall, reduction of chromium oxide permits chromium carbide to form, which bonds the carbon nodule to the combustor wall. Similarly, when a yttria stabilized zirconia thermal barrier coating is coated on the combustor wall, reduction of zirconium oxide permits zirconium carbide to form and bond the carbon nodule to the wall.

For the foregoing reasons, it would be desirable to provide some means for inhibiting the bonding of carbon nodules and carbon deposits to combustor walls in gas turbine engines.

More or less representative forms of thermal barrier coatings for use in gas turbine engines are described in U.S. Pat. No. 4,055,705 to Stephan Stecura and Curt Leibert, U.S. Pat. No. 4,248,940 to George Goward, Delton Gray and Richard Krutenat, U.S. Pat. No. 4,861,618 to Raymond Vine, Keith Sheffler and Charles Bevan, U.S. Pat. No. 5,073,433 to Thomas Taylor, and U.S. Pat. No. 5,514,482 to Thomas Strangman. These patents, however, make no mention of the carbon nodule problem and fail to suggest a solution to such problem.

SUMMARY OF THE INVENTION

In accordance with one feature of the invention, there is provided a carbon deposit inhibiting thermal barrier coating for an element (e.g., combustor wall) in a gas turbine engine. This coating comprises a layer of thermal barrier material formed on an exposed surface of a gas turbine engine element. This coating further comprises a layer of carbon deposit inhibiting material formed on top of the layer of thermal barrier material.

In accordance with another feature of the invention, there is provided an article for use in a gas turbine engine. Such article comprises a gas turbine engine element having a surface that will be exposed to burning engine gases and fuel droplets. Such article also includes a layer of thermal barrier material coated onto the engine element surface that will be exposed. This thermal barrier coating layer is typically composed of an insulative oxide layer and thin associated sublayers, such as an oxidation resistant bond coat that facilitates adhesion to the underlying surface. Such article further includes a layer of carbon deposit inhibiting material coated onto the outer surface of the thermal barrier material.

In accordance with a further feature of the invention, there is provided a method of forming a carbon deposit inhibiting thermal barrier coating on a gas turbine engine surface that will be exposed to the flow of burning engine gas and fuel droplets. Such method includes the step of depositing a layer of thermal barrier material onto the engine surface that will be exposed to the gas flow. Such method includes the further step of depositing a layer of carbon deposit inhibiting material onto the layer of thermal barrier material.

For a better understanding of the present invention, together with other and further advantages and features thereof, reference is made to the following description taken in connection with the accompanying drawing, the scope of the invention being pointed out in the appended claims.

DETAILED DESCRIPTION OF THE INVENTION

Figure 1:
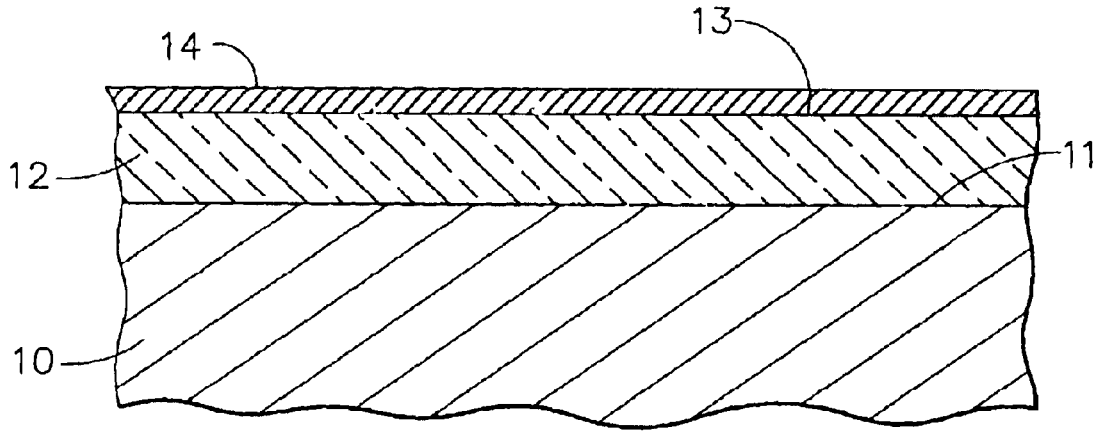
FIG. 1 is an enlarged cross-sectional view of a portion of a combustor wall having a novel coating of the present invention deposited thereon.

The present invention provides a novel carbon deposit inhibiting thermal barrier coating for use on internal gas turbine engine surfaces that will be exposed to the flow of burning engine gas and fuel droplets. A primary candidate for the application of this coating is the internal wall of the engine combustor. FIG. 1 shows a portion of a combustor wall 10. An inner surface 11 of wall 10 would be exposed to the flow of engine fuel combustion gases in the absence of the novel coating of this invention. Wall 10 is typically made of a superalloy metal such as a nickel based alloy or a cobalt based alloy.

The coating of this invention includes a layer 12 of thermal barrier material that is formed on the inner surface 11 that would otherwise be exposed to the high temperature engine gases. Thermal barrier layer 12 may be composed of a ceramic material such as, for example, a predominately yttria stabilized zirconia material. Thermal barrier layer 12 should have a thickness in the range of five to one hundred mils. In addition, thermal barrier layer 12 typically has thin associated sublayers (not shown), such as an oxidation resistant bond coat that facilitates adhesion to the underlying surface 11.

The coating of this invention further includes a layer 14 of carbon deposit inhibiting material formed on top of the layer 12 of thermal barrier material. This carbon deposit inhibiting layer 14 may be coated onto the outer surface 13 of the thermal barrier layer 12. The carbon deposit inhibiting layer 14 may be composed of a non-reactive, non-reducible, refractory oxide material. Primary requirements for this refractory oxide material are high temperature stability to oxidizing combustion gases that may contain up to 20% water vapor and to carbon-rich reducing environments. Such material should also have diffusional stability with respect to the underlying ceramic thermal barrier layer 12. Examples of oxides that meet these criteria are alumina, yttria, and lanthanum oxide. These oxides are not reduced by carbon at temperatures below 2000 degrees Centigrade, a temperature well above the use temperature of combustors. Furthermore, these materials exhibit a high degree of stability on the thermal barrier coating 12 due to their good bonding characteristics and their compatible thermal expansion characteristics. The carbon deposit inhibiting layer 14 should have a thickness in the range of one to fifty mils, and in some embodiments from one to five mils.

The carbon deposit inhibiting layer 14 may be preferably applied to the thermal barrier layer 12 by plasma spraying immediately following deposition of the thermal barrier layer 12, which may also be applied by plasma spraying. This strategy enables coating costs to be minimized by enabling both layers to be sequentially deposited in a single equipment set-up. Other processes that may be used to apply the protective layers include electron beam physical vapor deposition, chemical vapor deposition, and slurry dipping.

The carbon deposit inhibiting layer 14 of the present invention will inhibit the ability of carbon nodules to adhere strongly to combustor wall surfaces and will prevent carbon deposits from growing to a size sufficient to erode coated superalloys and turbine shroud coatings or to produce significant impact damage to ceramic engine components.

The present invention is not limited to the treatment of combustor walls. The novel coating of the present invention may also be applied to other internal engine components such as, for example, a swirler or fuel nozzle tip. Furthermore, the internal engine element to be coated may be formed of either a superalloy or a ceramic material, such as a silicon carbide composite or a silicon nitride material.

While there have been described what are at present considered to be preferred embodiments of this invention, it will be obvious to those skilled in the art that various changes and modifications may be made therein without departing from the invention and it is, therefore, intended to cover all such changes and modifications as come within the true spirit and scope of the invention.

We claim:

1. A method of forming a carbon deposit inhibiting thermal barrier coating on a gas turbine engine surface that will be exposed to the flow of burning engine gas and fuel droplets, the method comprising:

a) depositing a layer of thermal barrier material onto the engine surface that will be exposed; and b) depositing a layer of carbon deposit inhibiting material onto the outer surface of the layer of thermal barrier material, wherein:

the layer of carbon deposit inhibiting material is a layer of yttria or a layer of lanthanum oxide, and the layer of carbon deposit inhibiting material is not reduced by carbon at temperatures below 2000° C.

2. The method of claim 1, wherein the thermal barrier material is predominantly stabilized zirconia.

3. The method of claim 1, wherein the layer of thermal barrier material is deposited to a thickness in the range of 5 to 100 mils.

4. The method of claim 1, wherein the layer of carbon deposit inhibiting material is yttria, and the layer of carbon deposit inhibiting material is deposited to a thickness in the range of 1 to 50 mils.

5. The method of claim 1, wherein he layer of carbon deposit inhibiting material is deposited to a thickness in the range of 1 to 5 mils.

6. The method of claim 1, wherein both the layer of thermal barrier material and the layer of carbon deposit inhibiting material are deposited by plasma spraying.

7. The method of claim 6, wherein step b) is performed immediately following step a), and wherein step a) and step b) are performed by the same equipment.

8. The method of claim 1, wherein the layer of thermal barrier material and the layer of carbon deposit inhibiting material are deposited by a process selected from the group consisting of plasma spraying, electron beam physical vapor deposition, chemical vapor deposition, and slurry dipping.

9. The method of claim 1, wherein the carbon deposit inhibiting thermal barrier coating consists essentially of:

the layer of thermal barrier material; and the layer of carbon deposit inhibiting material, wherein the layer of thermal barrier material comprises yttria stabilized zirconia.

10. The method of claim 1, wherein the layer of carbon deposit inhibiting material is yttria.

11. The method of claim 1, wherein the layer of carbon deposit inhibiting material prevents carbide bonding of carbon to the engine surface that will be exposed.

12. The method of claim 1, wherein the gas turbine engine surface comprises a swirler or a fuel nozzle tip.

13. A method of forming a carbon deposit inhibiting thermal barrier coating on a gas turbine engine surface, comprising:

a) depositing a layer of thermal barrier material on the gas turbine engine surface; and b) depositing a layer of carbon deposit inhibiting material directly on the layer of thermal barrier material, wherein the layer of thermal barrier material comprise a ceramic having a thickness in the range of 5 to 100 mils, wherein the layer of carbon deposit inhibiting material is a layer of yttria or a layer of lanthanum oxide, and wherein the layer of carbon deposit inhibiting material has a thickness in the range of 1 to 50 mils.

14. The method of claim 13, wherein the gas turbine engine surface comprises a silicon carbide composite or a silicon nitride material.

15. The method of claim 13, wherein the gas turbine engine surface comprises a nickel based superalloy or a cobalt based superalloy.

16. The method of claim 13, wherein the gas turbine engine surface comprises an internal wall of a combustor.

17. The method of claim 13, wherein the layer of carbon deposit inhibiting material inhibits the adherence of carbon nodules to the gas turbine engine surface.

18. The method of claim 13, wherein the layer of carbon deposit inhibiting material is yttria and has a thickness in the range of 1 to 5 mils.

19. The method of claim 13, wherein the layer of carbon deposit inhibiting material is not reduced by carbon at temperatures below 2000° C.

20. The method of claim 13, wherein the layer of thermal barrier material comprises an oxidation resistant bond coat.

21. A method of forming a carbon deposit inhibiting thermal barrier coating on a gas turbine engine surface, comprising:

a) depositing a layer of thermal barrier material on the engine surface; and b) depositing a layer of carbon deposit inhibiting material on the layer of thermal barrier material, wherein:

the carbon deposit inhibiting material is a refractory oxide that is not reduced by carbon at temperatures below 2000° C., and the layer of carbon deposit inhibiting material has a thickness of 50 mils.

22. The method of claim 21, wherein:

said step a) comprises depositing a layer of stabilized zirconia to a thickness in the range of 5 to 100 mils, and wherein the refractory oxide is selected from the group consisting of alumina, yttria, and lanthanum oxide.

23. The method of claim 21, wherein the layer of carbon deposit inhibiting material comprises yttria.

24. A method of forming a carbon deposit inhibiting thermal barrier coating on a gas turbine engine surface, consisting essentially of:

a) depositing a layer of thermal barrier material on the gas turbine engine surface; and b) depositing a layer of carbon deposit inhibiting material directly on the outer surface of the layer of thermal barrier material, wherein the layer of carbon deposit inhibiting material is a layer of yttria or a layer o lanthanum oxide.

25. The method of claim 24, wherein:

said step a) comprises plasma spraying the layer of thermal barrier material on the engine surface, and said step b) comprises plasma spraying the layer of carbon deposit inhibiting material on the layer of thermal barrier material.

* * * * *